United States Patent [19]

Pitts et al.

[11] Patent Number: 5,033,899

[45] Date of Patent: Jul. 23, 1991

[54] INDEX MEDIA FOR LOOSE-LEAF NOTEBOOKS AND WIREBOUND NOTEBOOKS

[75] Inventors: Warren R. Pitts, Needham; Richard Naughton, W. Hatfield, both of Mass.

[73] Assignee: Dennison Manufacturing Company, Framingham, Mass.

[21] Appl. No.: 453,716

[22] Filed: Dec. 20, 1989

[51] Int. Cl.[5] ..... B42F 21/12

[52] U.S. Cl. ..... 402/80 R; 283/36; 283/38; 402/79; 402/80 L

[58] Field of Search ..... 283/36, 37, 38, 39, 283/40, 41, 42, 43; 402/79, 80 R, 80 L

[56] References Cited

U.S. PATENT DOCUMENTS

| | | | |
|---|---|---|---|
| D. 309,155 | 7/1990 | Hing | 283/36 X |
| 1,241,049 | 9/1917 | Stevens | 283/36 |
| 3,324,823 | 6/1967 | Peters | 283/38 X |
| 3,473,827 | 10/1969 | Leadbetter | 283/36 X |
| 4,000,915 | 1/1977 | Strom | 283/36 X |
| 4,422,672 | 12/1983 | Levi | 402/80 R X |

FOREIGN PATENT DOCUMENTS

| | | | |
|---|---|---|---|
| 739255 | 9/1943 | Fed. Rep. of Germany | 283/36 |
| 2656020 | 8/1978 | France | 402/79 |
| 179074 | 5/1922 | United Kingdom | 283/42 |

*Primary Examiner*—Paul A. Bell

*Attorney, Agent, or Firm*—Arthur B. Moore

[57] ABSTRACT

Low cost index media for use with loose-leaf binders and wirebound notebooks. An index tab includes a base portion having a plurality of apertures engagable by rings of a ring binder, and an index portion which projects beyond documents within the notebook in order to display index indicia. The index portion is integral with but offset from the base portion to define a clearance region which prevents interference between the index tab and an actuator lever for the loose-leaf binder. A second indexing article consists of an index sheet having a base portion and index portion, the base portion being of comparable dimensions to the documents within the notebook, and being bindable within the notebook. The index portion is foldable relative to the base portion, and may include preprinted index indicia as well as an area for inscribing merge information associated with respective indices. Preferably, duplicate index indicia and information is inscribed on both faces of the index portion thereby to display such information either in the folded-in or folded-out configuration.

7 Claims, 7 Drawing Sheets

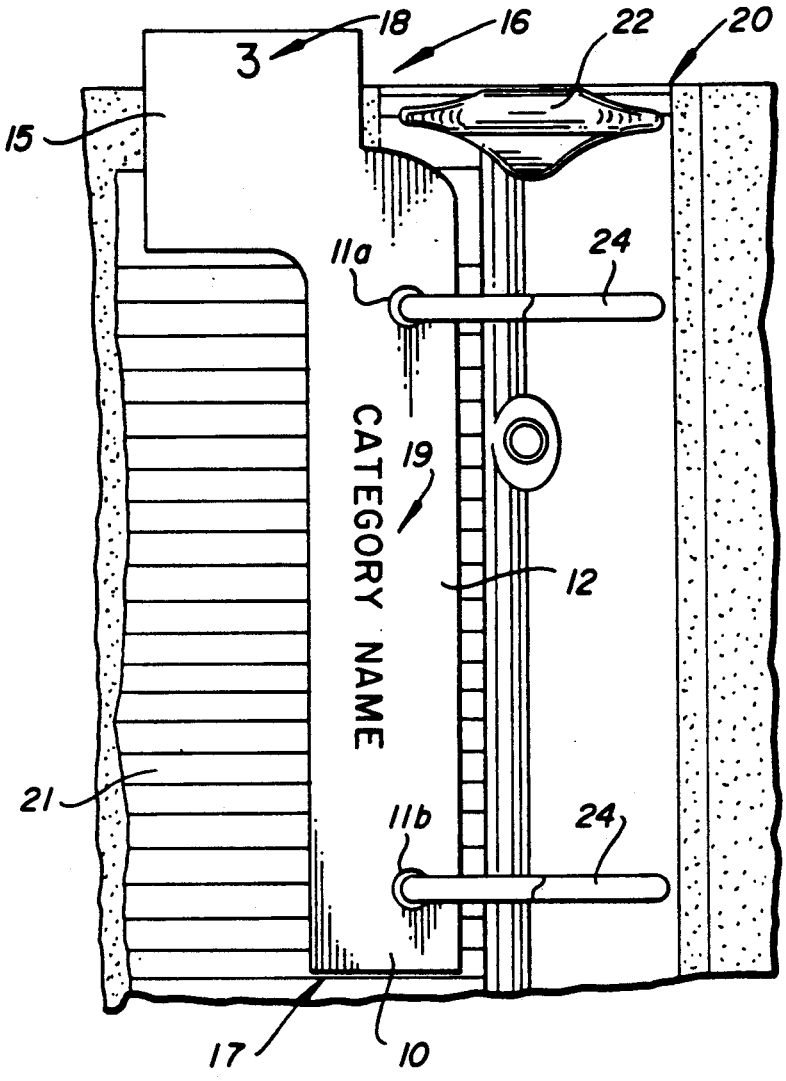
FIG. 1
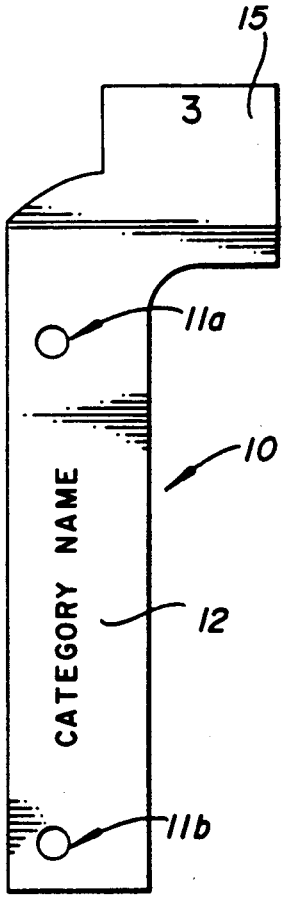
FIG. 2
FIG. 3
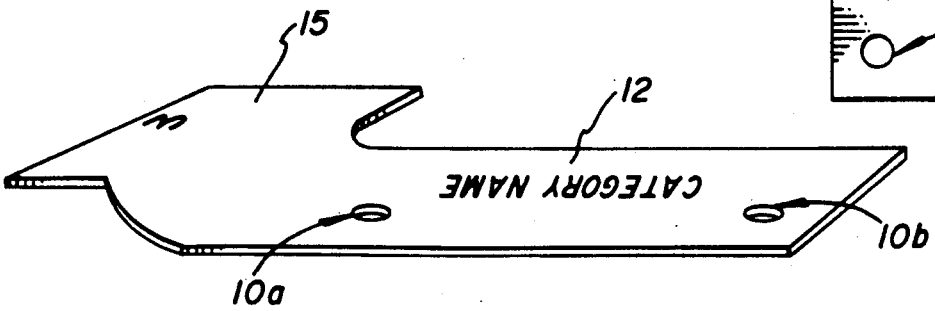

INDEX MEDIA FOR LOOSE-LEAF NOTEBOOKS AND WIREBOUND NOTEBOOKS

BACKGROUND OF THE INVENTION

The present invention relates to index media for three-ring binders, wirebound notebooks and the like. More particularly, it relates to flexible, low cost index media for these applications.

A wide variety of index media are available for three-ring binders. It is desirable to provide index media which are easily inscribed by the user and deployed in the appropriate locations within a notebook, and which facilitate locating documents. The invention relates to low cost index media which are conveniently used with three-ring binders as well as wirebound notebooks. Such index media facilitate the finding of documents thereby providing a worthwhile time savings.

SUMMARY OF THE INVENTION

The invention provides, in a first embodiment, an index tab including a base portion having apertures for binding the tab into a ring binder, and an index portion which protrudes from documents within the ring binder to display index indicia, said index portion being integral with but offset from the base portion, thereby to avoid interference of the index tab with an actuator lever of the ring binder. The offset between the base portion and index portion defines a clearance region thereby to avoid such interference. In addition to the index indicia on the index portion, further indexing information may be inscribed on the base portion which would be visible when the notebook is opened to reveal the entire tab.

Such identification indices may be provided individually, or may be separably joined in sheet form. In the latter, sheet form embodiment, the sheet may include in addition to the various index tabs, an index table portion, which may provide a table of the index category information associated with respective index indicia.

In a second embodiment, the invention provides a flexible index sheet for ring binders and wirebound notebooks, such sheet including a base portion which is comparable in dimensions to other documents which are bound into the notebook and which includes suitable means for binding the base portion to the notebook; and an index portion which may be folded against the base portion, or alternatively folded out to project from documents within the notebook. Advantageously, the fold out index portion includes an array of index indicia corresponding to the indicia inscribed on index tabs for the notebook; and an index table portion providing category information for the respective index tabs. In a preferred version of this second embodiment, both sides of the index portion are inscribed with duplicate index information so that the same information is displayed whether said index portion folded out or folded against the notebook. Such flexible index sheet may be easily inscribed by hand, typing or machine printing.

In the embodiment in which such index sheet is to be bound into a ring binder, the base portion includes a series of apertures for engagement by the binder rings. When such sheet is intended to be bound into a wirebound notebook, the sheet may be provided with a marginal adhesive strip for adhesively engaging the wirebound notebook.

Index media, in accordance with either of the above embodiments, may be made from a variety of materials, including paper, cardboard, plastic film, etc.

BRIEF DESCRIPTION OF THE DRAWINGS

The above and additional aspects of the invention are illustrated in the following detailed description of the preferred embodiments, together with the drawings in which:

FIG. 1 is a partial perspective view of a loose-leaf notebook carrying an index tab in accordance with the invention;

FIG. 2 is a plan view of an index tab of the type shown in FIG. 1;

FIG. 3 is a perspective view of the index tabs of FIG. 2;

FIG. 7 is a perspective view of a loose-leaf notebook housing the index sheet of FIG. 5, with the index portion folded in;

DETAILED DESCRIPTION

Figure 4:
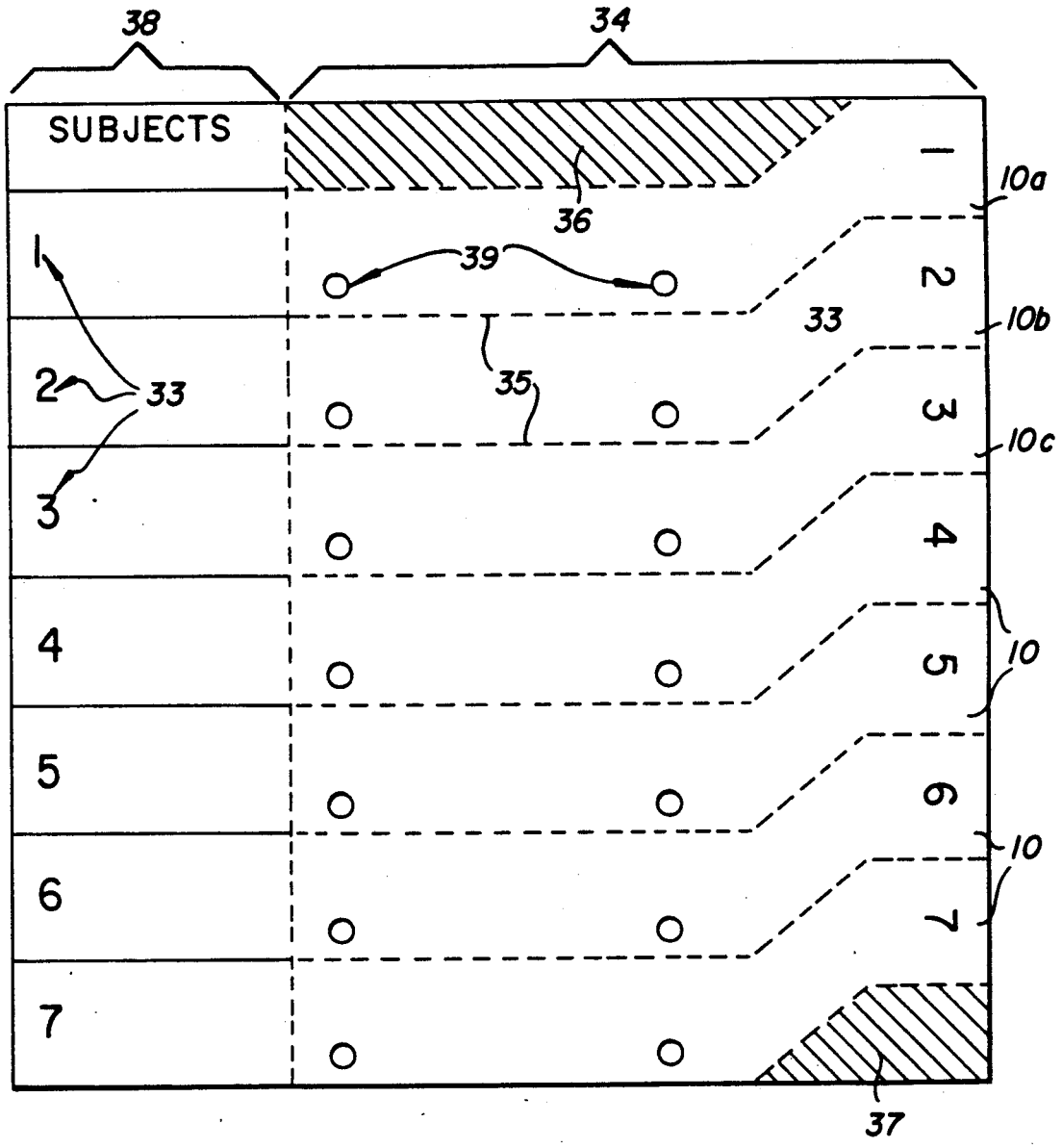
FIG. 4 is a plan view of a sheet of separable index tabs of a slightly different configuration to that shown in FIG. 2.

Reference should not be had to FIGS. 1–3 which illustrate a low cost convenient index tab for loose-leaf notebook, in accordance with a first embodiment of the invention. The index tab 10 shown in FIG. 1 includes a base portion 12 and an index portion 15. The base portion 12 includes two apertures 11A, 11B which permit the tab to be captured by two of the three binder rings 24 of a loose-leaf notebook 20. The index portion 15 is configured to project from documents 21 within the loose-leaf notebook 20 thereby to display index indicia 18 (here "3"). It will be seen that the index portion is integral with but offset from the base portion 12 thereby to define a clearance region 16. This clearance region avoids interference between index tab 10 and an actuator lever 22 of loose-leaf notebook 20. In addition to the index indicia 18 inscribed on the index portion 12, index information 19 may be inscribed on the base portion 12 of index tab 10.

The left edge of index tab 10 is aligned with the margin of document 21 thereby permitting the user to imprint document 21 without interference by index tab 10. The location of base portion 12 within the documents' margin area means that index tabs located between documents will not so deform the uppermost document as to interfere with printing.

Although the index tab 10 is shown on the left side of this view, it may be (and more typically would be) displayed on the right side with the indicia 18, 19 inscribed on the opposite face of the index tab 10. Index tab 10 may be made from paper, cardboard, plastic film and other sheet form materials. Index tab 10 could also be an erasably markable medium thereby permitting an individual tab to be reused.

Index tabs 10 may be provided as individual articles, such as illustrated in FIGS. 2 and 3. Alternatively, as shown in FIG. 4, a series of index tabs 10*a*, 10*b*, etc. may be die cut within a sheet 30 from which they are separable along perforation lines or score lines 35. The index tabs 10 each include a pair of apertures 39, and are configured to dovetail together in an array on an index area 34 of sheet 30. Filler sections 36 and 37 may be discarded when separating individual index tabs 10 from sheet 30. Index sheet 30 also includes a table area 38 which the user may inscribe to provide a listing of information associated with respective index tabs. Index information may be conveniently typed onto both the table area 38 and the index area 34 of index sheet 30, while index indicia 33 may either be preprinted or inscribed by the user.

Figure 5:
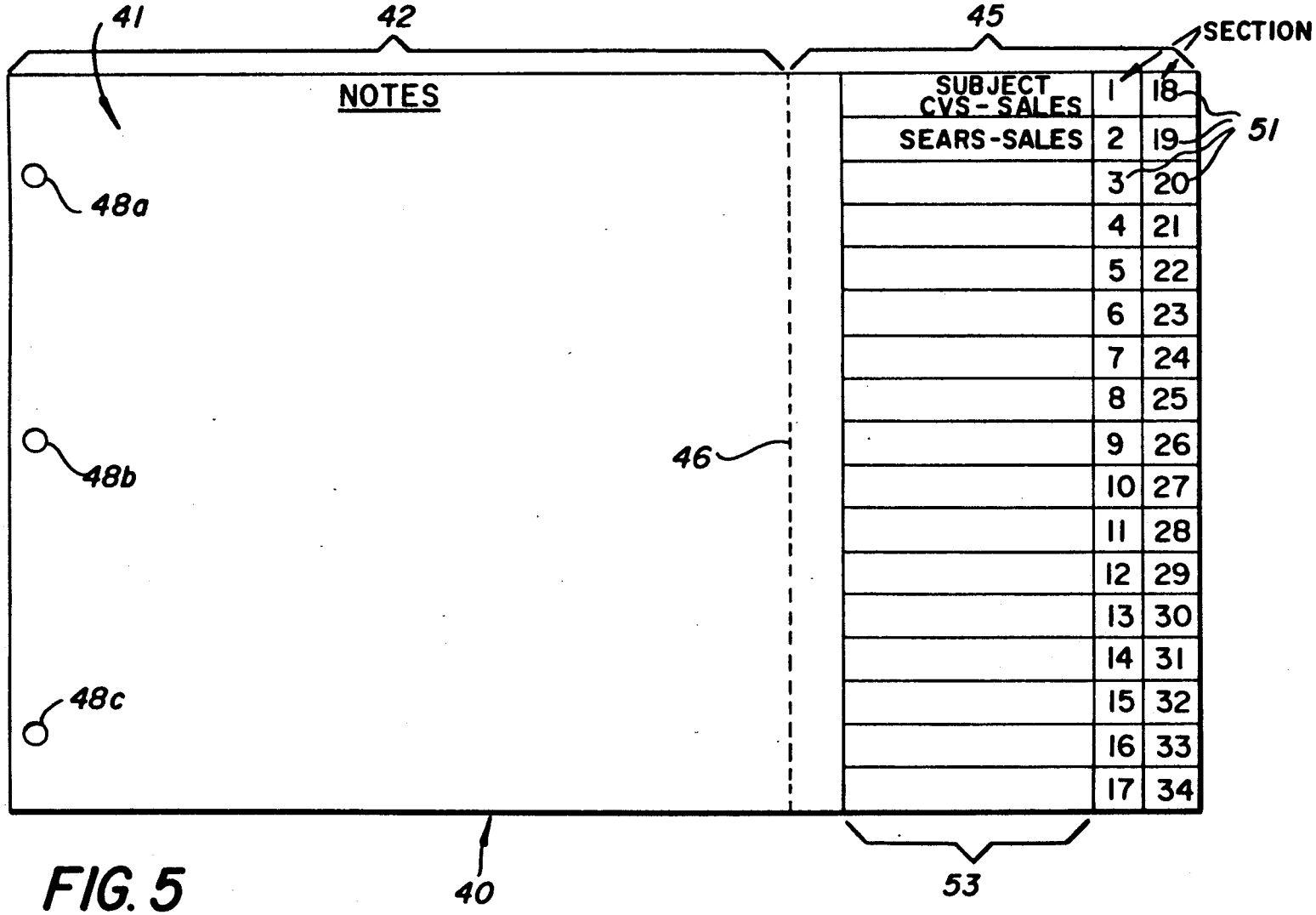
FIG. 5 is a plan view of a fold out index sheet according to a second embodiment of the invention.

FIG. 5 gives a plan view of a fold out index sheet 40 according to a second embodiment of the invention. Index sheet 40, the top face 41 of which is shown in FIG. 5, includes a base portion 42 and index portion 45 separated by fold line 46. Base portion 42 is advantageously dimensioned to be compatible with the documents which are bound within a loose-leaf notebook or wirebound notebook with which the index sheet 40 is intended to be used. In the embodiment of FIG. 5, for use with three-ring binders, the base portion 42 includes three apertures 48*a*–48*c* for engaging the binder rings of the loose-leaf binder.

Figure 6:
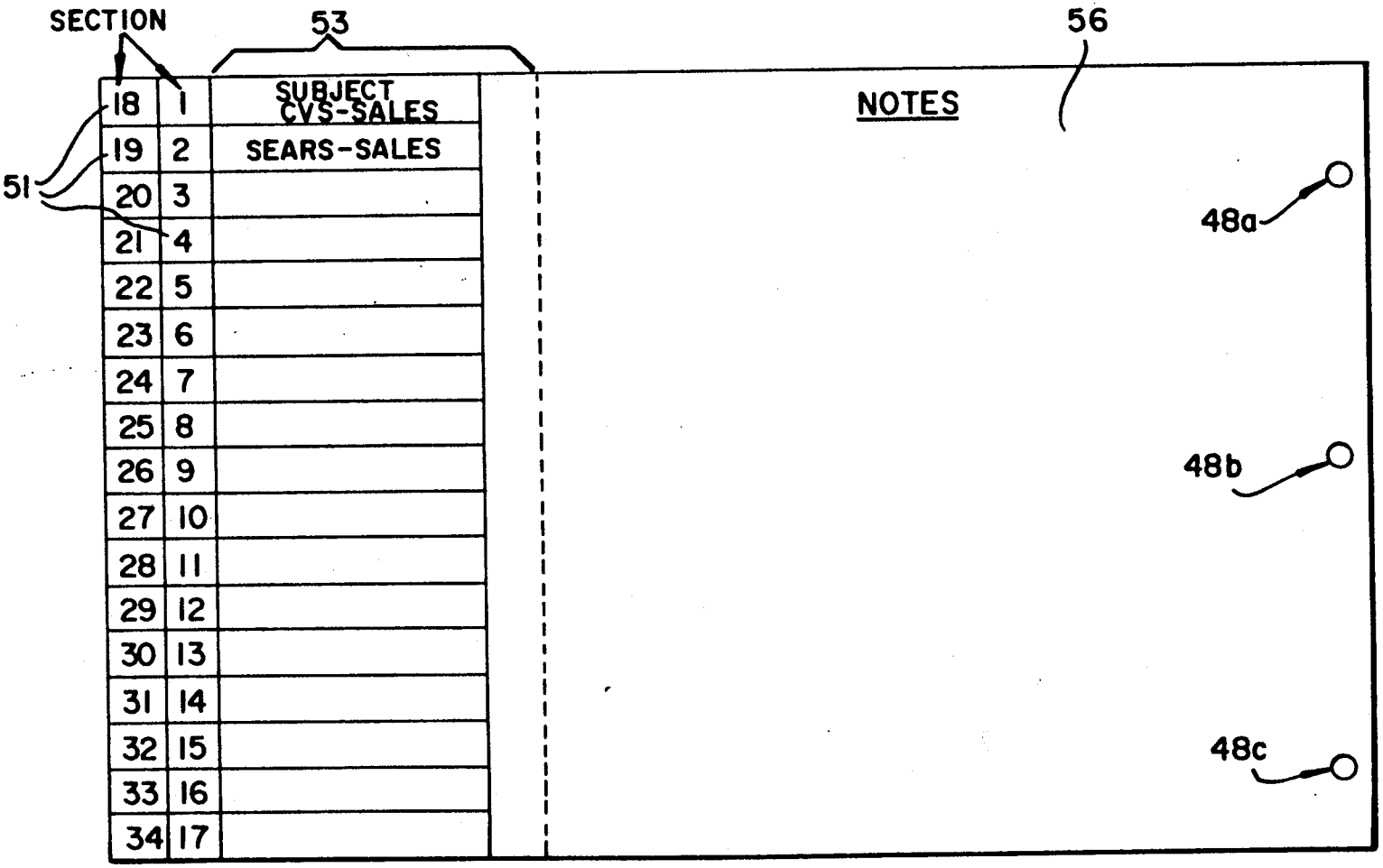
FIG. 6 is a plan view of the reverse face of the index sheet of FIG. 5.

The index portion 45 of sheet 40 includes an array of section numbers 51 as well as a table area 53 in which the user inscribes, for example, categories associated with respective section numbers. Advantageously, as shown in FIG. 6, information on the reverse face 56 of index sheet 40 (the preprinted section numbers 51 or other index indicia, and index category information 58 inscribed by the user) duplicates that on the front face of the index portion. This information may be handwritten, typed or printed onto the index portions of sheet 40 with the index portion folded out, or if the index sheet is too wide to fit into the typewriter or printer in this configuration, with the index sheet folded in. In the latter instance, the user would first insert the sheet facing one way (say, with face 41 upward) and the index portion folded against the upper face, then turn the sheet over and fold the index portion against the opposite face.

Figure 7:
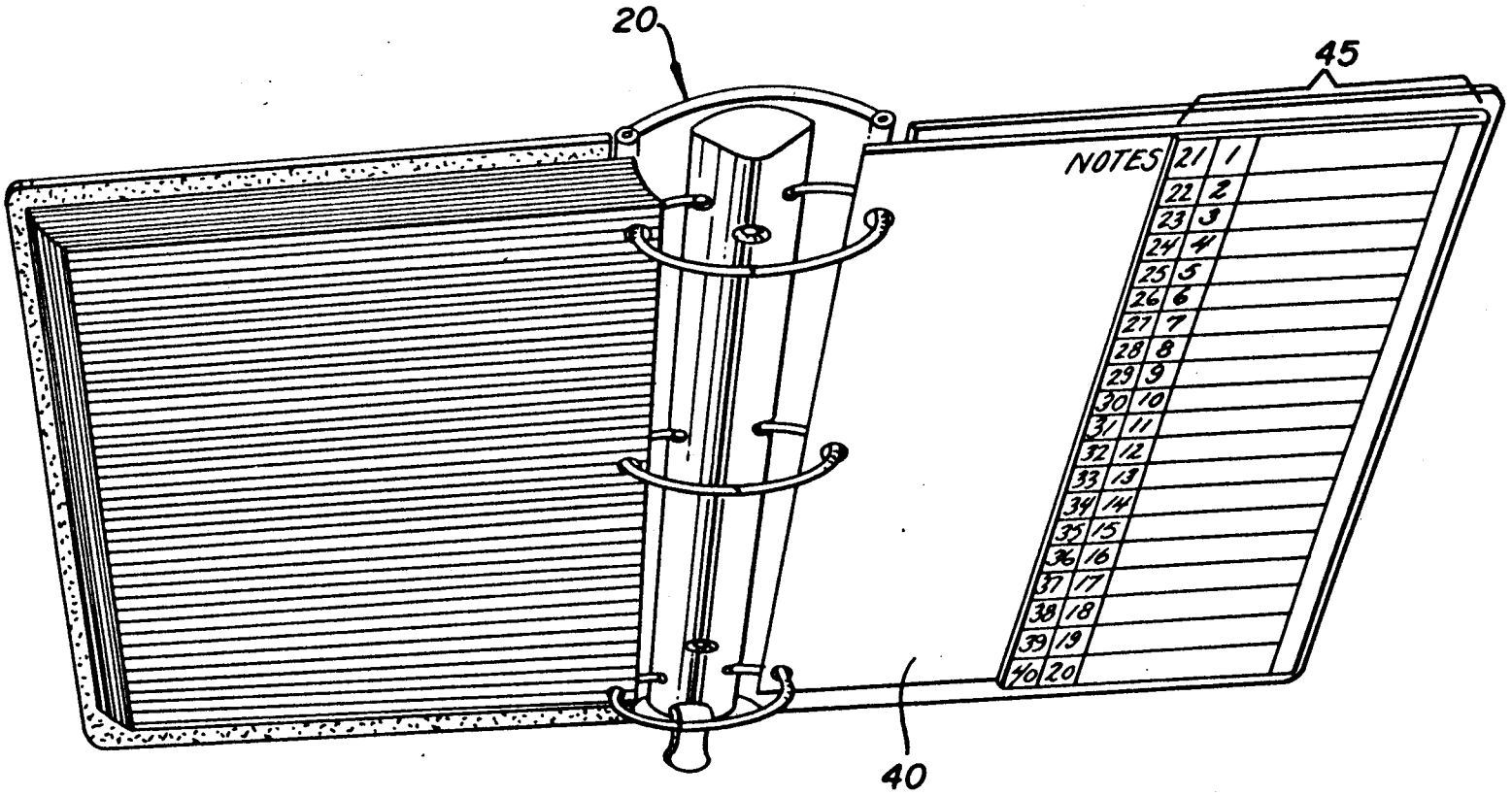
Figure 8:
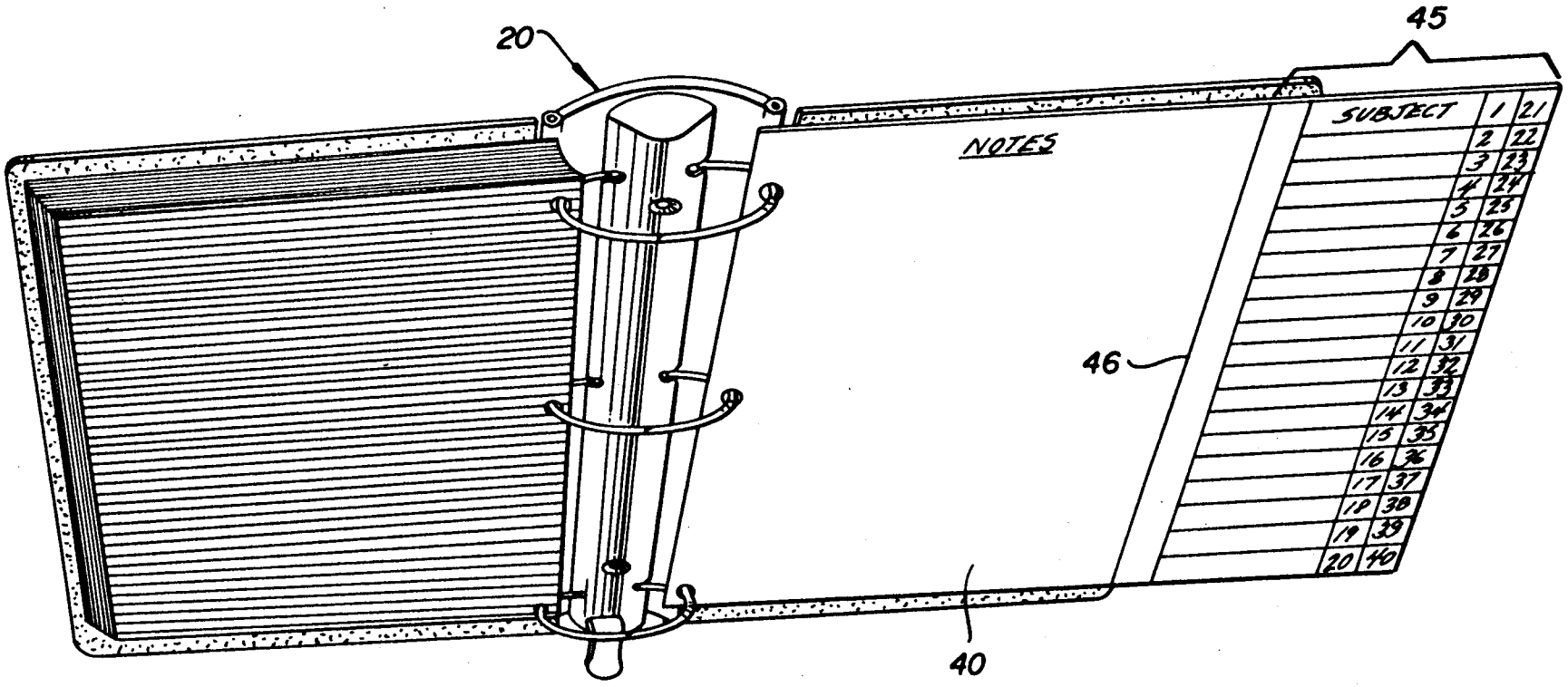
FIG. 8 is a perspective view of a loose-leaf notebook corresponding to that of FIG. 7, but showing the index portion folded out.

As shown in FIGS. 6 and 7, with the index portion of sheet 40 folded in, the sheet is compatible with the other documents contained within the notebook and does not project from the notebook or from the other sheets contained within the notebook, whereas with the index portion folded out, this portion of sheet 40 projects beyond the other documents within loose-leaf notebook 40 in order to permit convenient reference to the index table with the notebook either closed or opened to another document.

Figure 9:
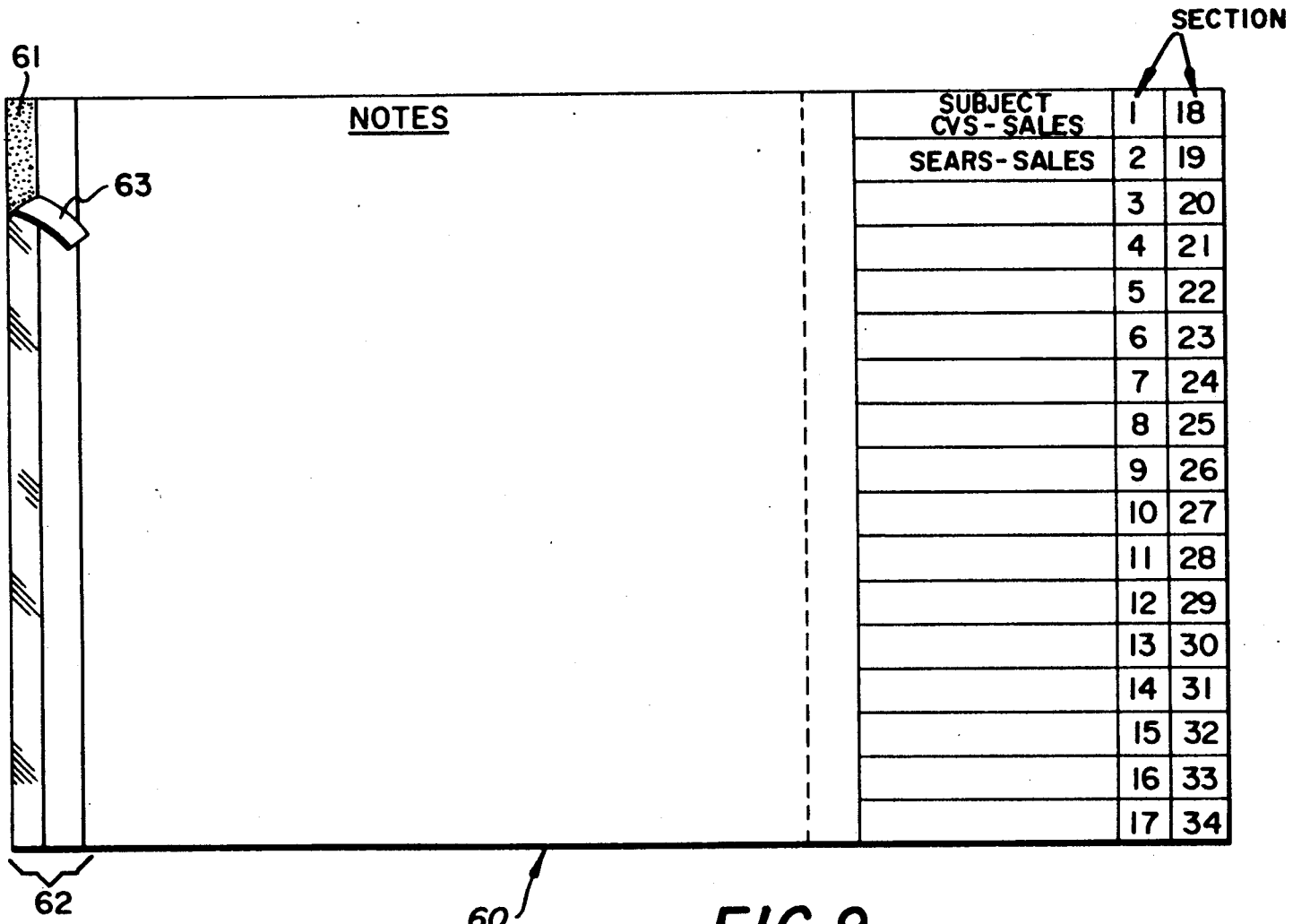
FIG. 9 is a plan view of a fold out index sheet in accordance with an alternative version of the second embodiment of the invention.

As shown in the alternative index sheet 60 of FIG. 9, such sheet may be designed for placement within a wirebound notebook by providing a marginal adhesive strip 62 including pressure sensitive adhesive 61 (which could be removable or permanent adhesive) covered by a removable release sheet 63. Such adhesive strip 62 may be so attached to the index sheet 60, or alternatively may be provided as a separate item which is adhered to the index sheet by the user. In either instance, it is possible to provide the index sheet both with an adhesive strip and with a series of binding apertures punched both through the base sheet and release sheet, thereby to be compatible either with ring binders or wirebound notebooks.

We claim:

1. An index tab for use with a loose-leaf notebook, comprising a flat member including a base portion with a plurality of apertures located to permit the tab to be engaged by a plurality of rings of the loose-leaf notebook, and an index portion configured to project beyond documents contained within the ring binder when the index tab is engaged by said binder rings, each of said document having a margin area including apertures to engage the rings of the ring binders, and an area to be inscribed; said index portion being offset from said base portion to define a clearance region in order to prevent interference between the index tab and an actuator lever of the loose-leaf notebook, and said base portion being configured so as not to extend beyond the margin area of said documents into the area to be inscribed.

2. A sheet containing a plurality of index tabs, each index tab including a base portion having a plurality of apertures for engaging a plurality of rings of a loose-leaf ring binder, and an index portion configured to extend beyond documents contained within the ring binder when said index tab is engaged by the binder rings, wherein the index portion is offset from the base portion to define a clearance region in order to avoid interference between the index tab and an actuator lever of the ring binder, wherein a plurality of said index tabs are separably contained within the index tab sheet.

3. An index tab sheet in accordance with the claim 2 wherein the index tabs are juxtaposed sided by side in the index tab sheet, and are configured so that the right edge of one index tab dovetails with the left edge of the adjoining index tab.

4. An index tab sheet in accordance with claim 3, wherein adjacent index tabs are separated along perforation lines.

5. An index tab sheet in accordance with claim 2 further comprising a table portion for entering information associated with respective index tabs.

6. An index tab sheet in accordance with claim 5 wherein the index tabs and table portion are preprinted with index indicia and the table portion provides room for inscribing category information associated with respective index indicia.

7. An index tab sheet in accordance with claim 2 wherein the index tabs are preprinted with index indicia at their index portions.

* * * * *